US005269113A

United States Patent [19]

Dreizler

[11] Patent Number: 5,269,113

[45] Date of Patent: Dec. 14, 1993

[54] SPACER SUITED FOR BEING EMBEDDED IN CONCRETE

[76] Inventor: Siegfried Dreizler, Im Hegnach 5, D-7333 Ebersbach, Fed. Rep. of Germany

[21] Appl. No.: 655,452

[22] PCT Filed: Aug. 25, 1989

[86] PCT No.: PCT/EP89/00999

§ 371 Date: Feb. 26, 1991

§ 102(e) Date: Feb. 26, 1991

[87] PCT Pub. No.: WO90/02234

PCT Pub. Date: Mar. 8, 1990

[30] Foreign Application Priority Data

Aug. 27, 1988 [DE] Fed. Rep. of Germany ..... 3829084

[51] Int. Cl.[5] ..... E04H 12/00

[52] U.S. Cl. ..... 52/649.1; 52/653.2; 52/680; 52/686

[58] Field of Search ..... 52/725, 728, 652, 653, 52/680, 685, 686, 677; 249/91, 94, 96

[56] References Cited

U.S. PATENT DOCUMENTS

| | | | |
|---|---|---|---|
| 750,456 | 1/1904 | Hartman | 52/725 |
| 790,230 | 5/1905 | Stempel | 52/725 |
| 1,759,626 | 5/1930 | Ockels | 52/652 |
| 1,919,491 | 7/1933 | Waggoneer | 52/653 |
| 3,257,767 | 6/1966 | Lassy | 52/652 |
| 3,471,986 | 10/1969 | Swenson . | |
| 4,627,211 | 12/1986 | Foster, Jr. | 52/652 |
| 4,741,143 | 5/1988 | Forster, Jr. . | |
| 4,939,883 | 7/1990 | Swenson | 52/652 |
| 4,989,388 | 2/1991 | Schmidgall et al. | 52/652 |
| 4,999,965 | 3/1991 | Schmidgall et al. | 52/652 |

FOREIGN PATENT DOCUMENTS

| | | | |
|---|---|---|---|
| 262863 | 6/1968 | Austria | 52/725 |
| 893856 | 4/1951 | Fed. Rep. of Germany . | |
| 8704698 | 3/1987 | Fed. Rep. of Germany . | |
| 8806355 | 5/1988 | Fed. Rep. of Germany . | |
| 2289696 | 10/1974 | France . | |

*Primary Examiner*—Carl D. Friedman
*Assistant Examiner*—Lan M. Mai
*Attorney, Agent, or Firm*—Harness, Dickey & Pierce

[57] ABSTRACT

Spacer suited for being embedded in concrete, for use with wire reinforcements placed in the walls of concrete pipes cast in molds. One side of a basic body is provided with radially projecting mounting elements for connecting the basic body with the wire reinforcement. The radially opposite other side of the basic body is equipped with a spacer element projecting in radially opposite direction relative to the mounting elements and terminating by an inclined surface which extends substantially in axial direction for assisting the sliding movement when mounting the mold.

6 Claims, 3 Drawing Sheets

SPACER SUITED FOR BEING EMBEDDED IN CONCRETE

The present invention relates to a spacer suited for being embedded in concrete, for use with wire reinforcements placed in the walls of concrete pipes cast in molds, wherein radially projecting mounting elements for connecting the basic body with the wire reinforcement are provided on one side of a basic body, the radially opposite other side of the basic body being equipped with a spacer element projecting in radially opposite direction relative to the mounting element and terminating by an inclined surface which extends substantially in axial direction for assisting the sliding movement when mounting the mold.

A spacer of the type described above has been known from U.S. Pat. No. 4,741,143. The spacer disclosed by this publication serves for securing a reinforcing cage inside a cylindrical hole at a certain distance from the walls of the hole, which is to be filled completely with casting concrete, for the production of a solid column.

The side of the spacer where the latter is to be joined with the wire reinforcement displays mounting elements in the form of projecting wires which must be wound around the wire reinforcement for establishing the connection. The wall of the hole which is to be filled with casting concrete practically constitutes the mold for the solid cylindrical block to be produced. In order to enable the reinforcing cage, with the spacers fixed thereon, to be introduced in the axial direction and in well-centered relationship into the cylindrical opening to be filled with the casting concrete, the side of the spacer opposite the wire mounting elements is equipped with an oblique surface which extends in the axial direction and which is intended to facilitate the sliding movement.

However, it is a drawback of the spacer of the type described above that handling is extremely arduous, i.e. that mounting the spacer on the reinforcement is extremely time-consuming. The reason is that the wires have to be bent around the reinforcing bars and to be joined with the latter by twisting. The spacer as such consists of concrete in which the mounting elements are embedded. In spite of the oblique sliding surface provided, it cannot be excluded that gripping or jamming may occur between the relatively rough concrete material and a rough mold material, which may then lead to parts breaking off the spacer. In addition, a spacer of this type is not capable of resisting stresses in the circumferential direction. In the case of heavy circumferential stresses it cannot be excluded that the spacer may tilt laterally so that it can no longer guarantee the correct spacing in the radial direction, even if it may perhaps be caught by the reinforcement.

However, the described kind of stress, i.e. a force component acting in the circumferential direction, in fact is encountered in the production of cast concrete pipes. The mold used for such concrete pipes consists of an outer cylindrical mold and an inner central core which two elements define between them an annular space which is then filled with concrete. In contrast to the process of casting solid columns, where the concrete can be introduced centrally and where the poured concrete rises slowly, thus producing predominantly radial flow phenomena, pouring concrete into an annular cylindrical space gives rise also to a circumferential flow component. This is so because when concrete is poured at one point into the hollow mold of a concrete pipe, the concrete spreads uniformly in a substantially circumferential direction. The required spreading motion and compacting of the concrete is assisted by the use of vibrators, with the result that the wire reinforcement is likewise set into vibrating movement. This gives rise to forces acting in the circumferential direction which tend to displace the reinforcing cage in the circumferential direction, relative to the mold. In the presence of such stresses, a spacer of the type described above would tilt laterally so that there would be a risk of the reinforcement being embedded in the pipe in non-coaxial alignment.

DE-U 8704 698 describes a spacer for heavy reinforcements which consists of a concrete polymer and in which mounting elements are embedded in the form of wire loops. Although a spacer of this type is capable of absorbing considerable pressure in a direction vertical to the surface of the wire reinforcing mats, laterally directed forces may lead to the spacer coming off the reinforcement.

Now, it is the object of the present invention to provide a spacer which is easy to produce, easy to handle, which enables the wire reinforcement to slide smoothly in the axial direction relative to the mold, and which is suited to absorb not only radial forces, but also circumferential forces in such a way that a firm connection between the spacer and the reinforcement is guaranteed.

The invention achieves this object by the fact that the mounting elements are designed as resilient elements and can be clicked upon the wire reinforcement, that the basic body consists of a concrete polymer with at least two mounting elements, which enclose the wire reinforcement at least partially in form-locking engagement, being embedded in thicker material portions of the basic body, at a certain distance one from the other, viewed in the circumferential direction of the concrete pipe to be poured.

The resilient design of the mounting elements enables the spacer to be clicked easily upon the wire reinforcement. The fact that the mounting elements enclose the wire reinforcement partially in form-locking engagement ensures a firm, undetachable connection. As two mounting elements are provided at a certain distance one from the other, viewed in the circumferential direction, the spacer not only rests against the reinforcement at the point of contact of the basic body, but is additionally connected to it at the same level via two additional points spaced therefrom. To say it in other words, the spacer is in contact with the wire reinforcement in the circumferential direction over a considerable length. The mounting elements which are clicked upon the reinforcing bars and which enclose the latter partially in form-locking engagement guarantee the firm seat of the spacer on the reinforcement. The large contact surface, in the circumferential direction, ensures that the spacer cannot tilt under the action of forces acting in the circumferential direction. This behavior is further supported by the fact that the mounting elements are cast into thicker portions of the concrete which excludes the risk of the mounting elements being torn out of the spacer under the action of high circumferential stresses. However, the known measure of making the spacers from a concrete polymer provides the additional advantage that the spacers are easy to produce and that the spacers can be given a smooth, easily sliding and closed surface which permits a relative movement in axial direction between the spacers, after they have been clicked upon the reinforcement, and the wall of the mold, without any risk of jamming or breakage of the spacer material, as would be the case with spacers made from usual concrete.

The object underlying the invention is, thus, achieved in full.

According to a further improvement of the invention, the mounting elements are designed as wire elements projecting from the basic body.

This feature provides the advantage that, depending on the size of the concrete pipe to be produced, very strong and high-quality wire elements can be cast into the concrete so that even extremely high circumferential forces can be absorbed by these wire elements, i.e. that on the one hand they cannot be bent open in the area where they enclose the reinforcing bar partially in form-locking engagement and that on the other hand they are firmly seated in the concrete polymer in which they are embedded.

Another embodiment of the invention provides that some of the mounting elements engage peripheral sections, and other mounting elements engage axial sections of the wire reinforcement.

This feature, which is known per se, ensures in conjunction with the combined features of the invention an undetachable seat for the spacer, once it has been clicked upon the reinforcement, and guarantees that all forces acting in the radial, axial and even in oblique or diagonal direction, can be absorbed without the spacer getting detached. Oblique forces may occur, for example, when the reinforcing cage comes to rotate when it is lowered axially into the mold. The design of the spacers proposed by the invention then excludes the risk that some of the spacers may be torn off already at the time of insertion of the cage, if the latter should rotate.

According to another embodiment of the invention, the side of the basic body which carries the mounting elements is provided with at least one groove for receiving a section of the wire reinforcement.

It is particularly advantageous in this connection to provide at least one groove for receiving an axial section.

This feature provides the advantage that the spacer comes to rest on the corresponding reinforcing bar in form-locking engagement, in the area of the groove. In combination with the mounting elements arranged on both sides of the axial reinforcing bar engaged in the groove, this then provides an intimate connection between the spacer and the reinforcement, which on the one hand can be established by a simple click-on or snap-on operation and which on the other hand resists even extremely important stresses in the circumferential direction. Of course, this connection is also capable of resisting important axial stresses in the snap-on direction.

According to another embodiment of the invention, the spacer element has the shape of a segment of a circle, the center of the circle coinciding substantially with a mounting element which engages a peripheral section of the wire reinforcement. The vertex of the circle defines the point which is the most remote from the point at which the spacer is fixed on the reinforcing cage. It is the point where the spacer is in contact with the mold. Now, the greatest possible force or tilting moment occurs, due to the leverage phenomenon, when a relative movement occurs in the circumferential direction between the spacer and the mold, which is in contact with the latter at the vertex of the curvature. This tilting moment is counteracted in the best possible way by the advantageous arrangement of the mounting element at the level of the center.

Further details of the invention will become apparent from the following description of preferred embodiments of the invention in conjunction with the attached drawing, in which.

Figure 1:
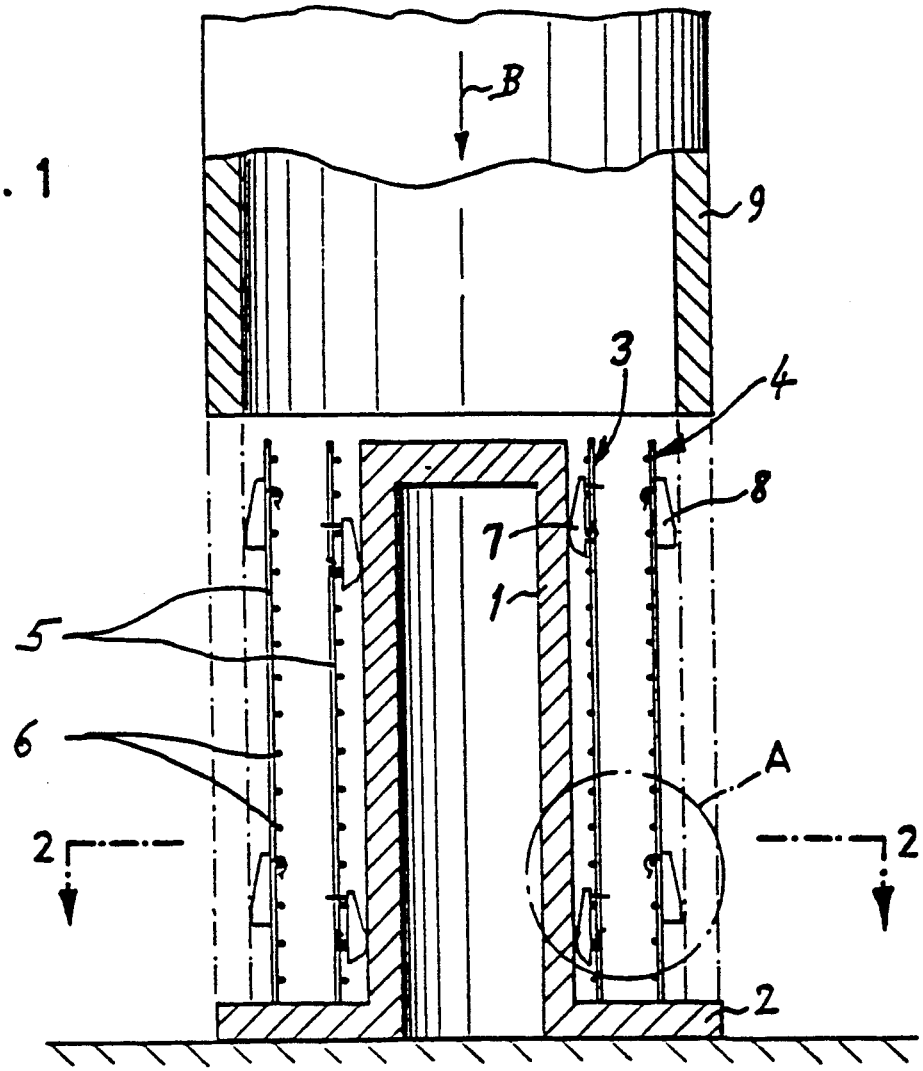
FIG. 1 is a diagrammatic view of a mold intended for casting concrete pipes, with two wire reinforcements arranged in the concrete wall.

The mold illustrated in FIG. 1, which is intended for casting concrete pipes of relatively large dimensions, for example in lengths of 3 m and with diameters of 1.20 m, comprises an inner core 1 projecting upwardly from a circular base plate over a length corresponding to the length of the concrete pipe to be cast. The inner core 1 is enclosed by an inner wire reinforcement 3 and an outer wire reinforcement 4 spaced a certain distance from the said wire reinforcement 3. The wire reinforcements 3, 4 comprise vertically extending metal bars 5 which also correspond substantially to the length of the finished concrete pipe and which are supported by the base plate 2. The metal bars 5 are connected, for example by welding, to substantially circular peripheral sections 6 which likewise consist of metal. Usually, the sections 6 form a spiral along the vertical bars 5. Consequently, the inner and outer wire reinforcements 3, 4 form self-supporting cages which may also be connected to each other.

Spacers 7, 8—which will be described in more detail further below—mounted on the wire reinforcements 3, 4 serve to hold the latter in a concentric position relative to the center axis of the inner core 1, and at an exactly defined spacing therefrom, the inner spacer 7, which is connected to the inner wire reinforcement, being in contact with the outer circumferential surface of the inner core 1, while the spacers 8, which are connected with the outer wire reinforcement, are in contact with an outer mold 9 which is fitted upon the inner core 1, in the direction indicated by arrow B, after the wire reinforcements 3, 4 with the spacers 7, 8 mounted thereon have been arranged about the inner core 7.

As the inner wire reinforcement 3 is mounted on the inner core 1, the spacers 7 slide along the latter's outer circumferential surface and ensure in this manner that the inner reinforcement is exactly centered. When the inner wall of the outer mold 9 is mounted on the inner core 1, it slides along the spacers 8 whereby the wire reinforcement 4 is centered.

Once the wire reinforcements 3, 4 have been mounted on the inner core and the outer mold 9 has been fitted in place, concrete is filled into the space between the inner core 1 and the mold 9, in the area of the wire reinforcements 3, 4. The inner core 1, together with the base plate 2 supporting the outer mold 9, are preferably placed on a vibrating table so that the concrete, which has been filled into the mold, can be compacted as desired.

Figure 3:
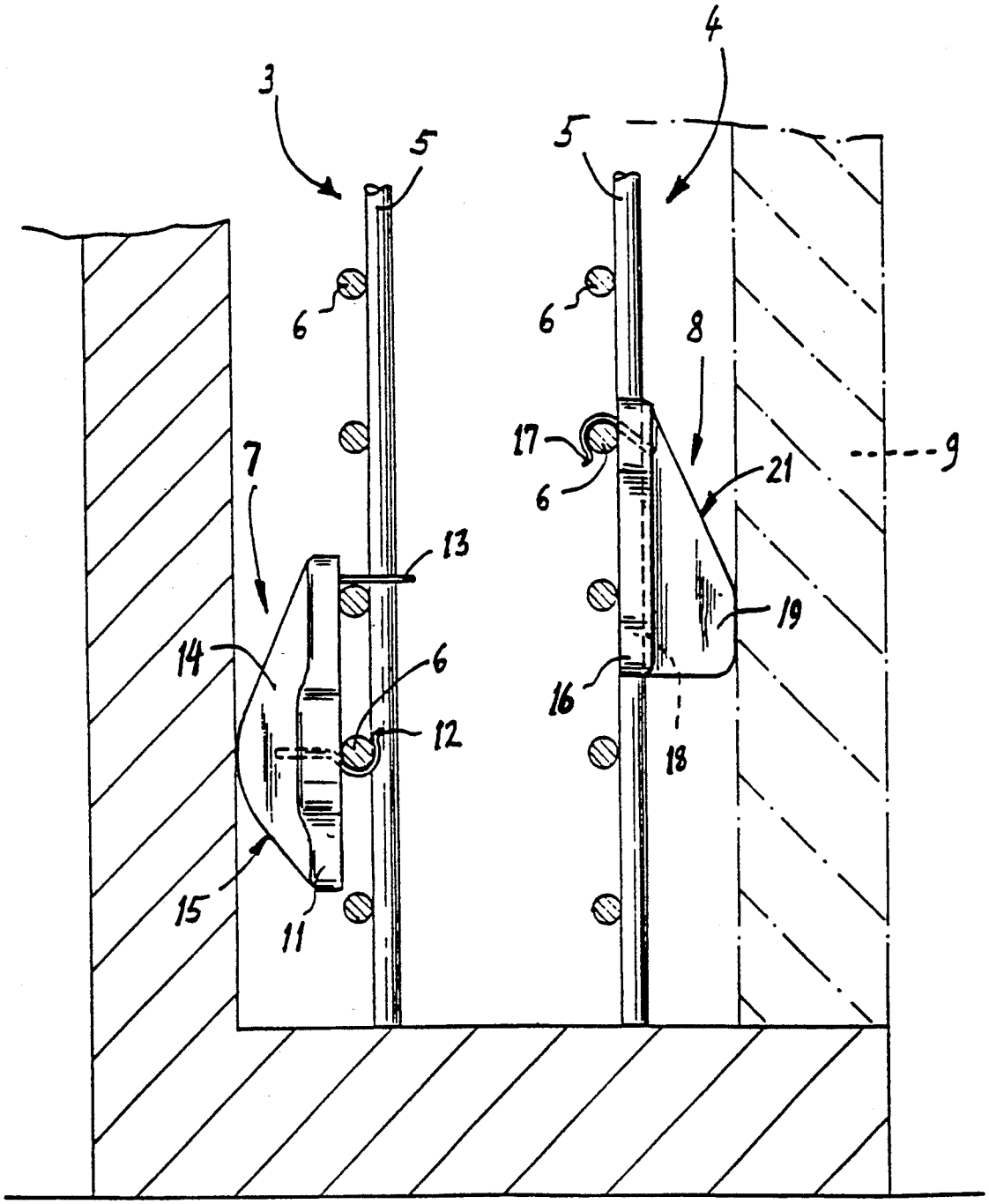
FIG. 3 shows a cross-sectional view of the detail indicated by the circle A in FIG. 1.
Figure 4:
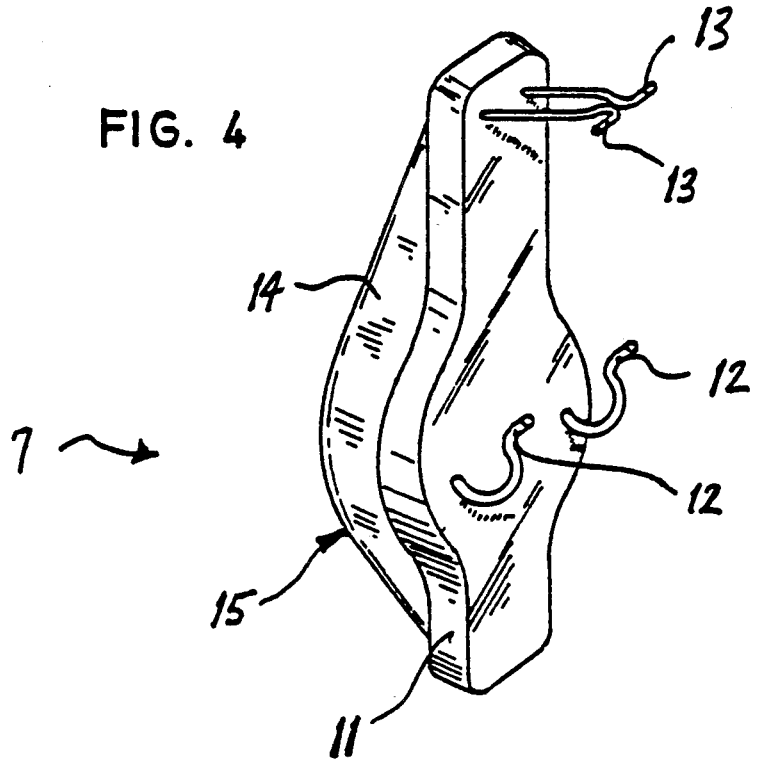
FIG. 4 shows a perspective view of a first spacer.
Figure 5:
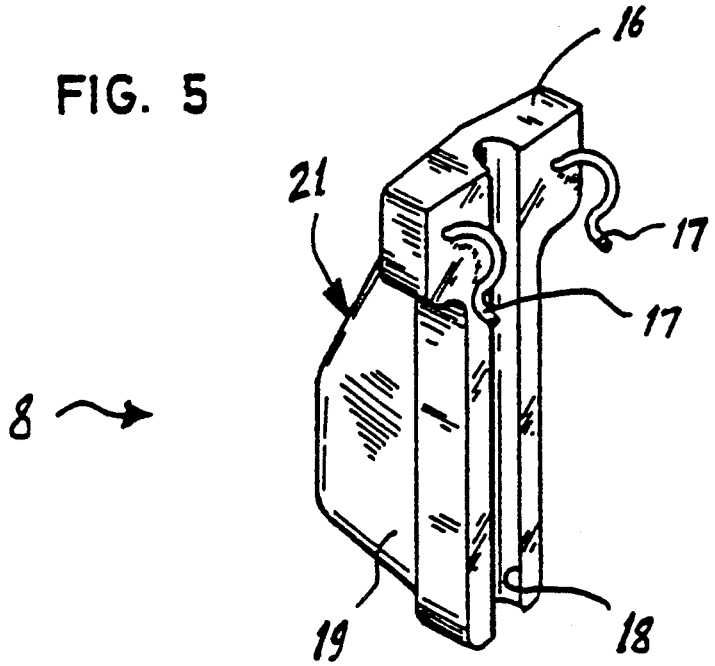
FIG. 5 shows a perspective view of a second spacer.

FIGS. 3 to 5 illustrate in detail the structure and operation of the spacers 7, 8.

The spacer 7 mounted on the inner wire reinforcement 3 comprises a basic body 11 made from a material whose thermal coefficient of expansion is substantially equal to that of the concrete used for the production of the pipe. Preferably, a concrete polymer, i.e. a mixture of a plastic material and sand, cement or the like, may be used for this purpose. One side of the basic body 11 (the right side in FIGS. 3 and 4) is provided with radially projecting mounting elements which serve as connection between the basic body and the inner wire reinforcement 3. These mounting elements comprise two lower wire elements 12 of curved shape which project from the basic body 11 and which are firmly inserted into the latter. Each of these wire elements 12 is intended for receiving a peripheral portion 6 of the wire reinforcement 3 from below, in form-locking or frictional engagement, and can be clicked easily upon the matching section 6. Two further wire elements 13 arranged one beside the other above the wire elements 12 engage the metal bar in frictional or form-locking manner so that they, too, enable the mounting element to be clicked upon the bar 5.

The side of the basic body 11 radially opposite the wire elements 12, 13 is equipped with a spacer element 14 in the form of a rib which projects in a direction radially opposite to the wire elements 12, 13 and which terminates by an inclined surface 15 extending substantially in axial direction and serving to facilitate the sliding movement along the inner core 1.

Figure 2:
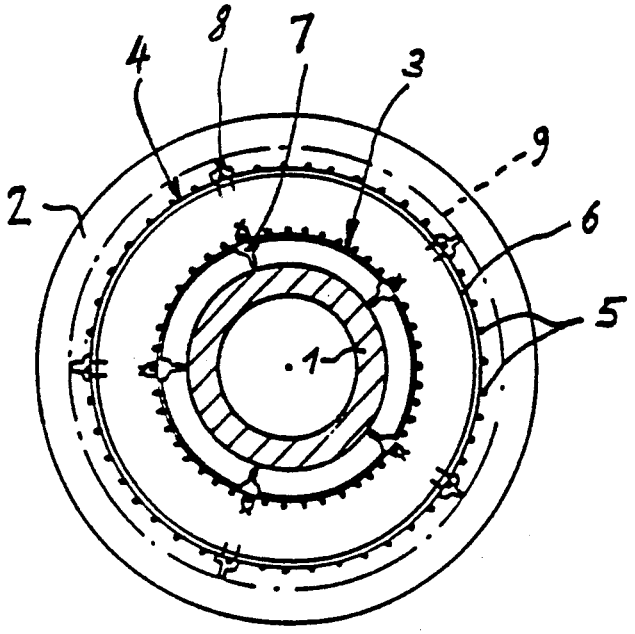
FIG. 2 shows a cross-sectional view along line 2—2 in FIG. 1.

As appears from FIGS. 1 and 2, several spacers 17 are mounted in vertically and peripherally spaced arrangement on the inner wire reinforcement before the latter is positioned on the inner core 1. During the sliding positioning movement, the inclined surfaces 5 slide along the outer surface of the inner core 1 so that the highest point of the rib 14 projecting the farthest to the inside comes to rest against the inner core 1 whereby it ensures the desired centering of the wire reinforcement 3. As the wire elements 12 embrace the sections 6 of the reinforcement from below, the spacers 7 are prevented from being dislodged in upward direction by the sliding movement between the reinforcement 3 and the inner core 1.

Advantageously, an additional section 6 of the reinforcement is left between the two wire elements 12, 13 for supporting the wall of the basic body from which the wire elements 12, 13 project (see FIG. 3).

The spacer 8 provided on the outer wire reinforcement 4 comprises likewise a basic body 16 consisting, for example, of a concrete polymer. Two wire elements 17 projecting from the upper end of the said body 16 correspond substantially to the wire elements 11 provided on the spacer 7, except that they engage the matching peripheral section 6 of the wire reinforcement from above, rather than from below. The wall from which the wire elements 17 project is provided with a groove 18 receiving part of the vertically extending metal bar thereby providing a vertical support for the spacer 8. The basic body 16 is again provided, on the side opposite the wire element 17, with a rib 19 with an inclined surface 21. When the outer wire reinforcement 4, together with the spacers 8, is placed upon the base plate 2 of the inner mold core 1 and the outer mold 9 is moved in place over the assembly, the outer mold comes to slide initially along the inclined surfaces 21 of the spacers 8, thereby centering the reinforcement 4, while in the end position the crown points of the rib 19 projecting the farthest in the radial direction come to rest against the inner face of the outer mold 9.

As illustrated in the drawing, all of the peripheral sections 6 of the wire reinforcements 3, 4 are arranged on the sides of the vertical metal bars 6 facing the inner core 1. It is ensured in this manner that the wall from which the wire elements 12, 13 of the spacer 7 project rests against peripheral sections 6 of the wire reinforcement 3, while the groove 18 of each spacer 8 engages a vertical bar 5.

The design of the spacers 7, 8 and their connection with the wire reinforcements 3, 4 are sturdy enough to ensure that they cannot get dislodged or distorted by any relative movements between the reinforcements and the parts 1 and 9 of the mold so that the reinforcements 3, 4 will in any case occupy an exactly centered position in the annular space of the mold to be filled with concrete. The distance between the wire reinforcements 3, 4 and the inner core 1 of the outer mold 9 is determined in any case by the crown heights of the projecting ribs 14, 19.

In the case of the embodiments of the mounting elements, i.e. the wire elements 12, 13 and 17, described so far all these elements are designed as parts separate from the basic body 11, 16. However, according to certain modified embodiments of these spacers, the mounting elements which serve for connecting the spacers with the wire reinforcements 3, 4 may also be formed integrally with the basic body 11, 16 which means that they may also consist of a concrete polymer, for example, and may be formed together with the spacers 7, 8 by the same molding or injection-molding process. For example, the basic bodies 11, 16 may be provided with projections which may be formed integrally from a concrete polymer and which may have a height similar to that of the wire elements 12, 13, 17, for engaging the wire reinforcements 3, 4 in the same manner as the wire elements 12, 13 and 17.

As appears particularly clearly from FIG. 3, the crown of the curved rib 14, which performs the funcion of a spacer element, has the shape of a segment of a circle whose center coincides substantially with the center line of the peripheral section 6 of the wire reinforcement 3 which is engaged by the wire element 12. If, therefore, the spacer 7 should come to tilt about the peripheral reinforcement section 6, during application of the inner reinforcement 3 on the inner core 1, for example due to the fact that the wire elements 13 get dislodged from the metal bar 5, such tilting would not change in any way the prescribed spacing between the wire reinforcement 3 and the outer wall of the inner core 1 as the crown of the rib 14 would insofar act as a circular roller.

Besides, a similar design in the form a circular disk may be provided also for the rib 19 in the area of its surface of contact with the inner wall of the outer mold 9. The concrete pipe described with reference to FIGS. 1 and 2 is a pipe with continuous wall. However, the described spacers can be used similarly for conventional concrete pipes of the type provided with a slot extending parallel to the pipe axis. Such "slotted" pipes are used, for example, as water drain pipes along highways in which case the water running off the road surface enters the interior of the pipe through the slot.

As will be seen best is FIGS. 3 to 5, the mounting elements (wire elements 12) are arranged in the lower area of the spacer 7, while the mounting elements (wire elements 17) are arranged in the upper area of the spacer 8.

I claim:

1. A spacer for being embedded in concrete and adapted for attachment to wire reinforcements placed in the walls of concrete pipes cast in molds, wherein the wire reinforcements includes axially oriented wire and circumferentially oriented wire, the spacer comprising:

a main body made of a polymer concrete, said main body having integrally formed on a first side thereof a spacer element projecting in a first radial direction and terminating by an inclined surface extending in an axial direction, and having provided on a second side opposite said first side at least one groove for receiving a wire of said wire reinforcement; and at least two resilient wire mounting elements extending in a second radial direction from said second side of main body, said resilient mounting elements having one end embedded in said main body and wherein the other end of each of said resilient mounting elements is designed to be clipped on another wire of said wire reinforcement.

2. Spacer according to claim 1, wherein said at least two mounting elements embedded in said main body are disposed on opposite sides of said groove.

3. Spacer according to claim 1, wherein said spacer element has the shape of a segment of a circle, a center of said circle coinciding substantially with one of said pairs of mounting elements.

4. Spacer suited for being embedded in concrete, for use with wire reinforcements placed in the walls of concrete pipes cast in molds wherein the wire reinforcements include axially oriented wire and circumferentially oriented wire, the spacer comprising:

a main body made of a polymer concrete, said main body is provided at a first side with a spacer element projecting from said main body in a first radial direction and terminated by an inclined surface extending in an axial direction, said main body is provided on a second side with at least one groove for receiving a wire of said wire reinforcement, said second side being radially opposite to said first side, said main body is further provided with at least two mounting elements designed as resilient elements having one end embedded in enlarged portions of said main body, said enlarged portions are disposed on opposite sides of said groove, and wherein said resilient elements project from said second side of said main body in a second radial direction, and each resilient element is designed to be clipped on another wire of said wire reinforcement.

5. Spacer according to claim 4, wherein said mounting elements are designed as wire elements.

6. Spacer according to claim 4, wherein said spacer element has the shape of a segment of a circle, a center of said circle coinciding substantialy with one of said mounting elements.

* * * * *